United States Patent [19]

Kallinger

[11] 4,277,052

[45] Jul. 7, 1981

[54] JACKING APPARATUS

[76] Inventor: Franz Kallinger, 58 Hunt Ter., Greenwich, Conn. 06830

[21] Appl. No.: 67,533

[22] Filed: Aug. 17, 1979

[51] Int. Cl.[3] ..... B66F 1/00

[52] U.S. Cl. ..... 254/106

[58] Field of Search ..... 254/105–111

[56] References Cited

U.S. PATENT DOCUMENTS

| | | | |
|---|---|---|---|
| 3,109,289 | 11/1963 | Roussel | 254/105 |
| 3,203,669 | 8/1965 | Johansson | 254/107 |
| 3,901,477 | 8/1975 | Ahl | 254/107 |

*Primary Examiner*—Robert C. Watson

*Attorney, Agent, or Firm*—Wegner, Stellman, McCord, Wiles & Wood

[57] ABSTRACT

A jacking apparatus for selectively moving a load in either of opposite directions such as vertically upwardly and downwardly. The apparatus is adapted for use in a wide range of building constructions, such as those using slipforms, wherein heavy loads are positioned by the jacking apparatus. The apparatus includes gripping elements having portions engaging elongated structural elements for effecting desired movement of the jacking apparatus in moving the load. The gripping elements are mounted on parallelogram linkage supports for maintained parallel relationship to the longitudinal extent of the elongated structural element with which they are selectively engaged. A control device is carried by the respective upper and lower gripping devices for effecting automatic control of the gripping elements in effecting a lowering of the apparatus when desired. The control is arranged to effect a sequential releasing and gripping of the elongated structural element by the gripping elements as an incident of individual movement of the respective gripping devices.

18 Claims, 12 Drawing Figures

FIG. 1
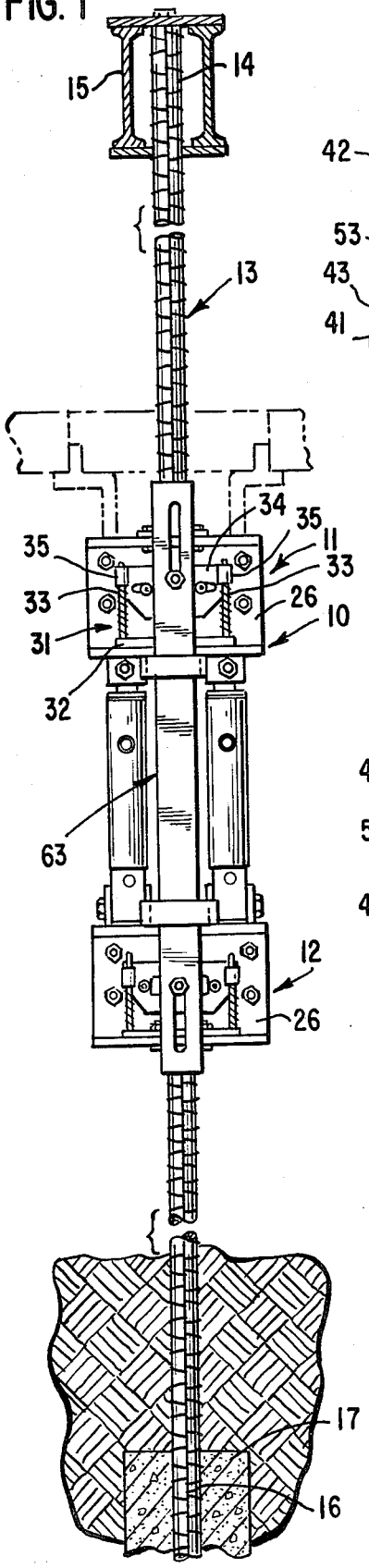
FIG. 2
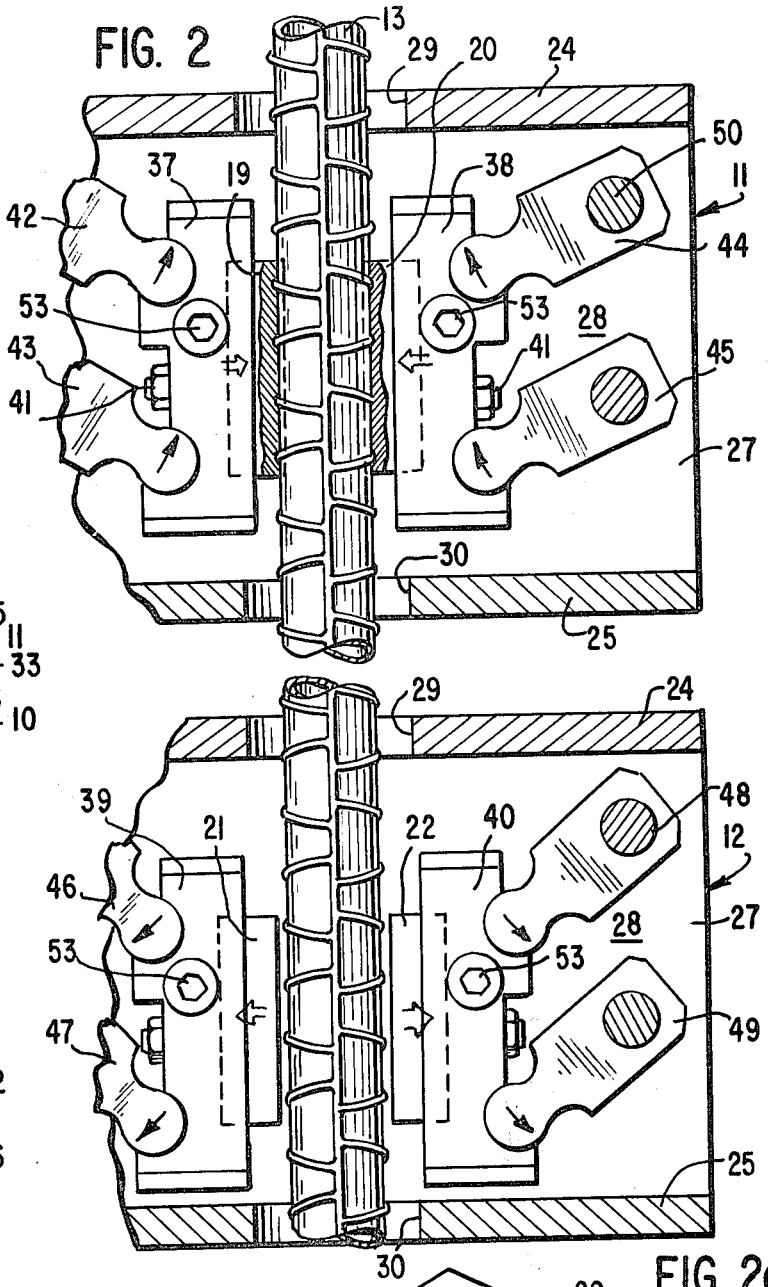
FIG. 2a
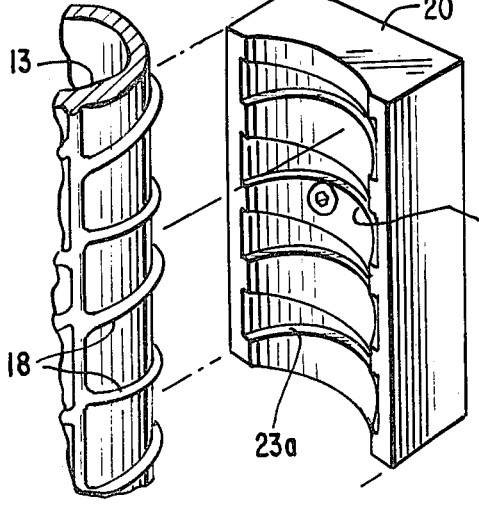
FIG. 3

JACKING APPARATUS

TECHNICAL FIELD

This invention relates to jacking apparatus, and in particular to jacking apparatus for use in moving relatively heavy loads such as in the construction industry.

BACKGROUND ART

In one conventional form of erecting buildings, each of the floors thereof may be formed of concrete by forming the individual floors at ground level and then raising the formed floor to the desired elevated level by suitable jacking apparatus. Such a method of constructing a building is illustrated in U.S. Pat. No. 2,686,420 of Philip N. Youtz. In the Youtz patent, the concrete floors are raised by means of tension screws or threaded lifting rods. Means are provided on the upper ends of support columns for acting on the screws and raising them. In one form, the lifting means is a center hole hydraulic jack which is mounted on the column so that the tension screw extends through the center of the jack. The lifting operation requires that the holding nut be turned down on the screws after each successive lifting step with the operation being repeated over and over again to effect the desired complete lifting of the slab.

Donald J. Bentley et al show, in U.S. Pat. No. 2,830,788, a pushing and pulling apparatus utilizing means for exerting a frictional grip on a caisson to hold it against movement in one direction while the caisson is being moved stepwise in the other direction. A fluid-operated gripper ring is provided for making temporary frictional engagement with the caisson. Pistons and cylinders are provided extending between the load and the gripper ring and are pivotally connected thereto to provide the desired powered operation of the apparatus.

In U.S. Pat. No. 2,920,870, George E. Suderow shows a system of jacking having manual controls effective to maintain a platform level during raising thereof on a plurality of supporting legs. The device utilizes a hydraulic control system wherein the jacking mechanisms for all of the legs of the device can be operated in unison.

Samuel Goldberg shows, in U.S. Pat. No. 3,065,573, a building construction wherein the floor slabs are raised with a uniform master lift pressure throughout the hydraulic system.

Bernard Ahl shows, in U.S. Pat. No. 3,325,146, a mold raising mechanism utilizing eccentrically mounted grabs including upper and lower grab heads connected to two independently operated extensible and contractible pressure fluid actuators for raising and lowering the grab heads selectively. One of the grab heads may be provided with releasable means to prevent an associated grab from clamping an associated climbing pole.

In U.S. Pat. No. 3,948,483, Jean Gonzagues de Leaumont shows a sliding shuttering raising device wherein the sliding shutterings are moved along a slide bar by means of jacks. The device includes means for preventing unintended backward movement.

In U.S. Pat. No. 3,973,885, Hans Schmidt shows an apparatus for constructing a wall including hydraulic jacks adapted to climb a vertically extending jack tube. The apparatus includes a formwork support structure, at least one pair of inner and outer formwork sections suspended from the support structure and at least one of which is adapted to move toward and away from the other. A jack means is provided for supporting the formwork support structure on a lower foundation or completed wall section and is arranged to lift the formwork support structure.

DISCLOSURE OF INVENTION

The present invention comprehends an improved apparatus for selectively moving a load which is extremely simple and economical of construction while yet providing a number of highly desirable features.

More specifically, the invention comprehends the provision of such a load lifting apparatus including gripping means having a surface configuration complementary to shoulder portions of the structural element with which the gripping means is engaged in effecting the desired movement of the load. The gripping means are thusly caused to have mechanically interlocking engagement selectively with successive ones of the spaced shoulder portions as the apparatus is caused to be brought successively to adjacent the successive ones of the shoulder portions.

The gripping means may be urged into accurate mechanical interlocked association with the shoulder portions of the structural element by spring-biased means as an incident of relative longitudinal movement between the elongated structural element and the gripping means.

The shoulder portions of the elongated structural element are substantially uniformly spaced and in the illustrated embodiment may have a spacing of approximately 2".

For further improved gripping engagement, the gripping means may be arranged to engage concurrently a plurality of the shoulder portions of the structural element.

The means for mounting the gripping means adjacent the structural element may include a parallelogram linkage for causing the gripping means to be maintained parallel to the longitudinal extent of the elongated structural element for further improved gripping engagement of the apparatus therewith. The mounting means may include a fixed cam and a cam follower movable with the gripping means for guiding the movement of the gripping means toward and from the structural element.

The apparatus may include biasing means for biasing the parallelogram linkage to cause engagement of the gripping means with the structural element.

The apparatus is further provided with a novel control means for effecting selective lowering of the gripping devices when desired. The lowering means may include extensible means for moving the gripping means selectively toward and from each other and control means carried by the upper gripping means for causing the lower gripping means to be released from the structural element as an incident of the upper gripping means being moved downwardly to a preselected minimum spacing of the upper gripping means above the lower gripping means while the lower gripping means is maintained in engagement with the structural element.

Second control means may be provided carried by the lower gripping means for causing the upper gripping means to be released from the structural element as an incident of the lower gripping means being moved downwardly to a preselected maximum spacing of the lower gripping means below the upper gripping means with the upper gripping means engaged with the structural element.

The extensible means may comprise fluid-operated piston means.

The control means may include a control member extending from one gripping means to adjacent the connector of the other gripping means and means defining a lost-motion connection therebetween. The lost-motion connection may comprise a vertical elongated slot in the control member with a follower carried by the connector movably receivable in the slot.

The control means is adapted to be readily installed in association with the apparatus when desired.

Thus, the jacking apparatus of the present invention is extremely simple and economical of construction while yet providing the highly desirable features as discussed above.

BRIEF DESCRIPTION OF THE DRAWING

Other features and advantages of the invention will be apparent from the following description taken in connection with the accompanying drawing wherein:

FIG. 1 is a fragmentary elevation of a jacking apparatus embodying the invention;

FIG. 2 is a fragmentary enlarged vertical section thereof;

FIG. 3 is a fragmentary perspective view illustrating the cooperating interlocking means between the gripping means and structural element;

BEST MODE FOR CARRYING OUT THE INVENTION

Figure 4:
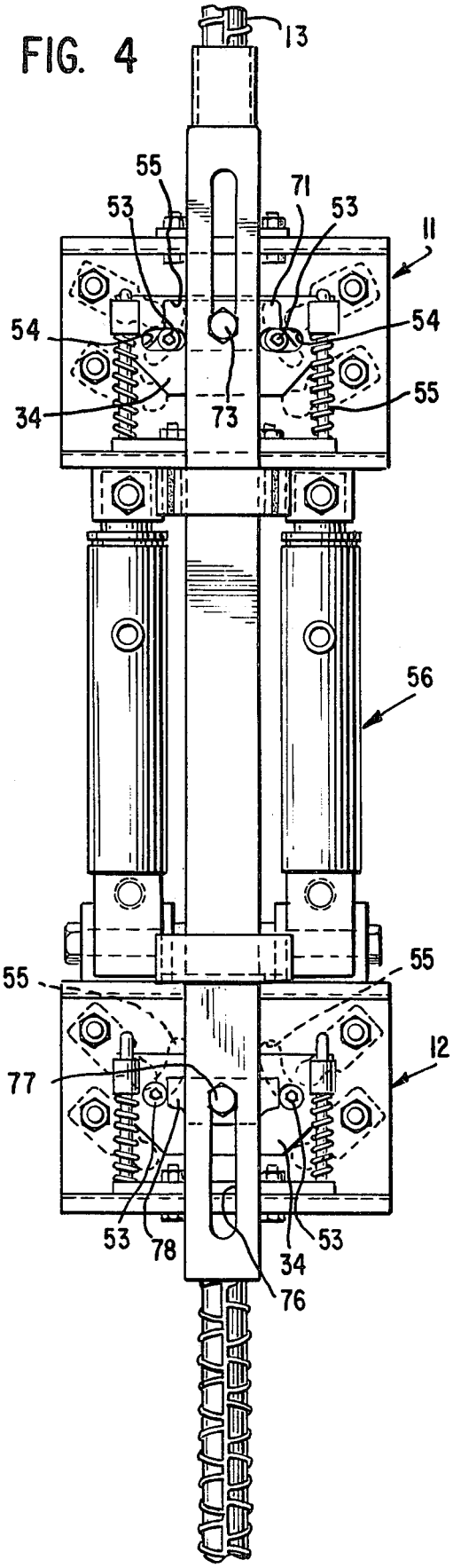
FIG. 4 is a fragmentary vertical elevation illustrating initial disposition of the jacking apparatus at initiation of a downward movement thereof.

In the illustrative embodiment of the invention as disclosed in the drawing, a jacking apparatus generally designated 10 is shown to comprise an upper gripping device 11 and a lower gripping device 12. The gripping devices 11 and 12 are arranged to have releasable gripping association with a structural support member 13 which, in the illustrated embodiment, comprises a vertical rod having an upper end 14 secured by an upper support 15, and a lower end 16 secured by an lower support 17 to dispose the structural element in a vertical arrangement, as shown in FIG. 1.

As shown in FIG. 3, the structural element is provided with a plurality of shoulder portions 18. Referring to FIG. 2, upper gripping device 11 includes a pair of jaws 19 and 20 and lower gripping device 12 includes a pair of jaws 21 and 22. Jaw 20 is illustrated in FIG. 3, it being understood that each of the other jaws is similar in construction. As shown in FIG. 3, the jaw defines an inner gripping surface 23 defined by a plurality of recesses **23*a*, which are complementary to the shoulders 18 of structural support member 13**, so as to define therewith mechanical interlock means for positively locking the jaw against movement relative to the support member when the jaw is brought into facial engagement therewith.

In the illustrated embodiment, the shoulder portions 18 define ribs spaced longitudinally of the structural member 13 and, illustratively, may be spaced apart approximately 2". Further, as shown in FIG. 3, the plurality of recesses **23*a* in surface 23 thereof are arranged to cooperate with a corresponding plurality of shoulder portions 18** to provide further positive interlocked engagement between the jaws and the support member.

Figure 7:
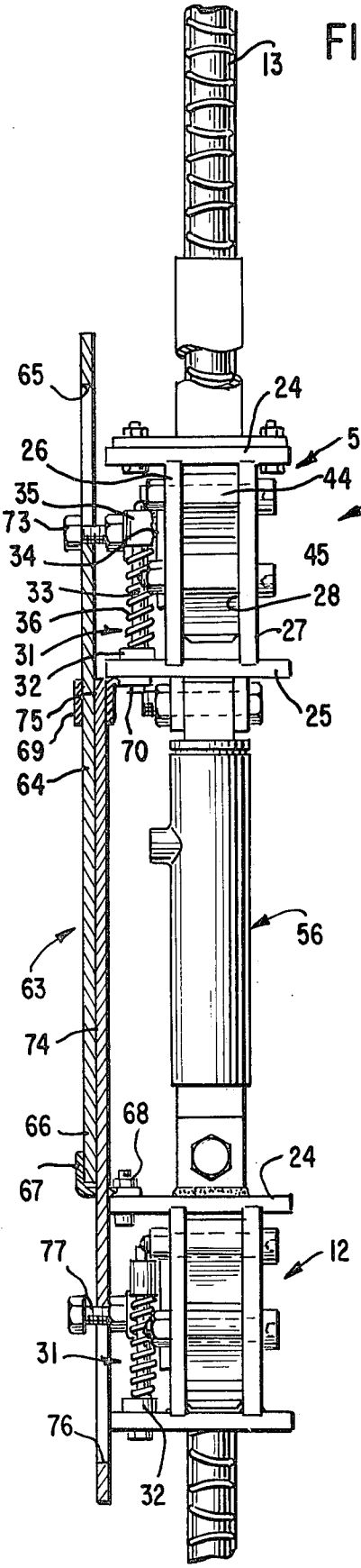
FIG. 7 is a side elevation of the apparatus as arranged in the position of FIG. 6.

Each of the gripping devices 11 and 12 includes a carrier 51 made up of a top plate 24, a bottom plate 25, a front plate 26, and a rear plate 27. A jaw space 28 is defined between the plates, as shown in FIG. 7, for receiving the gripping jaws. As shown in FIG. 2, top plate 24 is provided with an opening 29 and bottom plate 25 is provided with an opening 30 for freely passing the structural member 13 and thereby permitting movement of the respective gripping devices 11 and 12 longitudinally of the support member in the use of the jacking apparatus.

Figure 6:
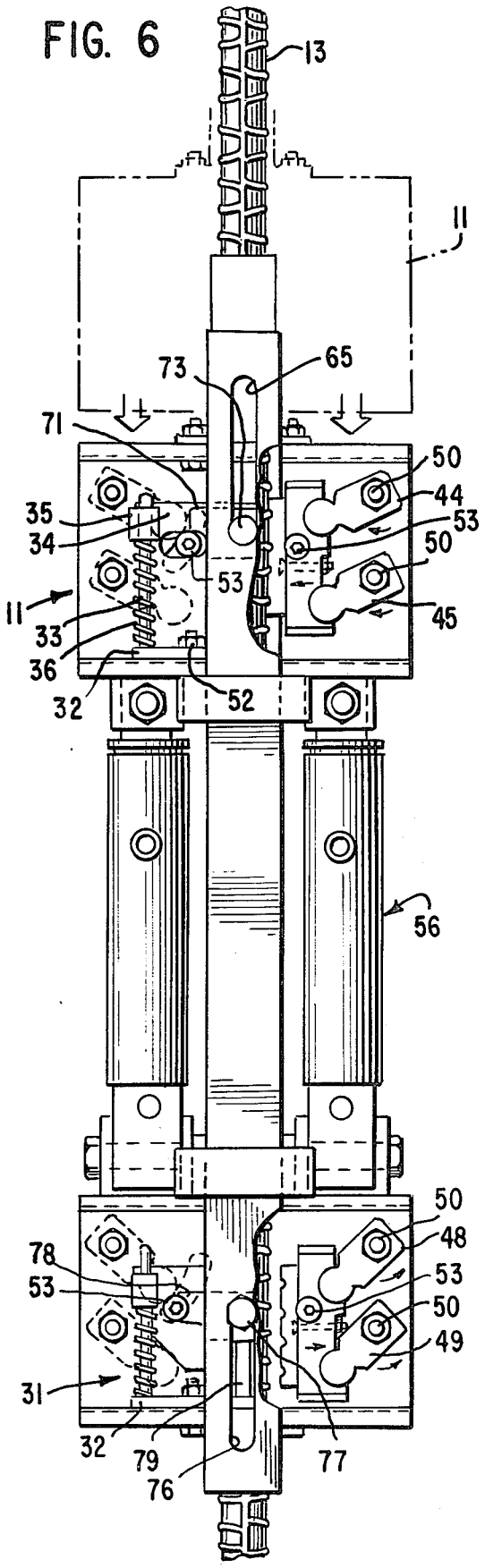
FIG. 6 is an elevation illustrating a third step in the downward movement of the apparatus.

Control of the movement of the jaws toward and from structural support member 13 is effected by means of a slide device 31 which, as shown in FIG. 7, includes a base 32 secured to the bottom plate 25 as by bolts 52. Upstanding from base 32 is a pair of pins 33. A jaw guide plate 34 is provided with a pair of connectors 35 which are slidably mounted to the pins 33, as seen in FIG. 6. Jaw guide plate 34 is biased upwardly by a pair of springs 36 mounted one each on the pins 33 to be compressed between the connectors 35 and base 32 of the slide device.

As further shown in FIG. 2, jaw 19 is carried on a carrier 37. The jaw may be secured to the carrier by suitable means, such as bolts 41. As further shown in FIG. 2, jaw 20 is similarly carried on a carrier 38, jaw 21 is similarly carried on a carrier 39, and jaw 22 is similarly carried on a carrier 40.

Each of carriers 37, 38, 39 and 40 is swingably mounted to the carrier 51 by means of a pair of links. Thus, as seen in FIG. 2, carrier 37 is swingably mounted to the carrier 51 by means of links 42 and 43, carrier 38 is swingably mounted to the carrier 51 by means of links 44 and 45, carrier 39 is swingably mounted to the carrier 51 by means of links 46 and 47, and carrier 40 is swingably mounted to carrier 51 by means of links 48 and 49. Each of the links is pivotally mounted to the front and rear plates 26 and 27, respectively, by pivot pins 50. As shown in FIG. 2, the links define parallelogram linkages with the associated pivot pins and jaw carriers so that the jaw carriers, and the jaws carried thereby, are maintained in accurate parallel relationship to the centerline of structural support member 13 in all positions of the carriers and jaws as they move toward and from the structural support member. Thus, an improved, positive engagement of the jaws, and more specifically the recesses 23 of the jaws, with the structural support member, and more specifically the shoulders 18 of the support member, is effected in the operation of the jacking apparatus.

As further shown in FIG. 2, each of the jaw carriers is provided with a guide pin 53. As seen in FIG. 4, the jaw guide plate 34 is provided with a pair of horizontally elongated slots 54 slidably receiving the front end of the respective pins 53. Front plate 26 is provided with a corresponding pair of kidney-shaped slots 55 into which the pins 53 rearwardly extend. Thus, as seen in FIG. 4, vertical movement of the guide pins 53 as caused by vertical movement of the jaw guide plate 34 causes the guide pins to follow the arcuate path defined by the kidney-shaped slot 55 and as a result thereof, effect swinging movement of the jaws carried on the carriers to which the guide pins 53 are secured.

Figure 8:
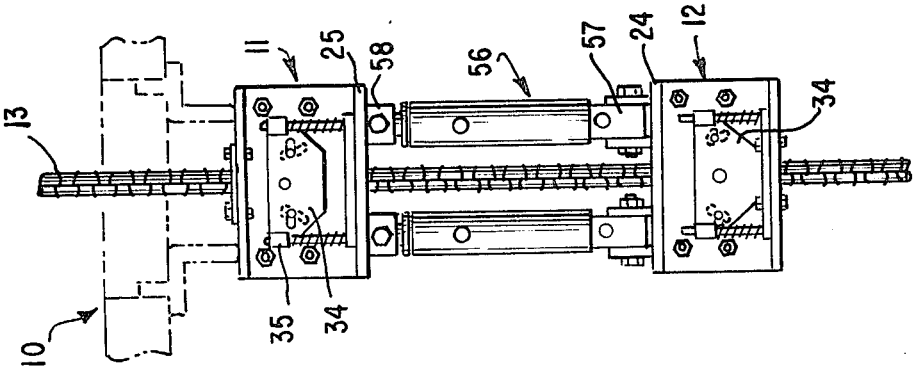
FIG. 8 is an elevation of the jacking apparatus as at the initiation of a lifting step.

As further illustrated in FIG. 8, jacking apparatus 10 further includes a pair of extensible devices generally designated 56 illustratively comprising hydraulic piston cylinder devices having one end 57 connected to the top plate 24 of the lower gripping device 12 and an upper end 58 connected to the bottom plate 25 of the upper gripping device 11. Thus, as can be seen in FIGS. 8–12, the extensible devices 56 define means for causing relative movement between the gripping devices 11 and 12 for effecting controlled sequential movement thereof such as in effecting the lifting of the load carried on the upper gripping device 11.

Figure 10:
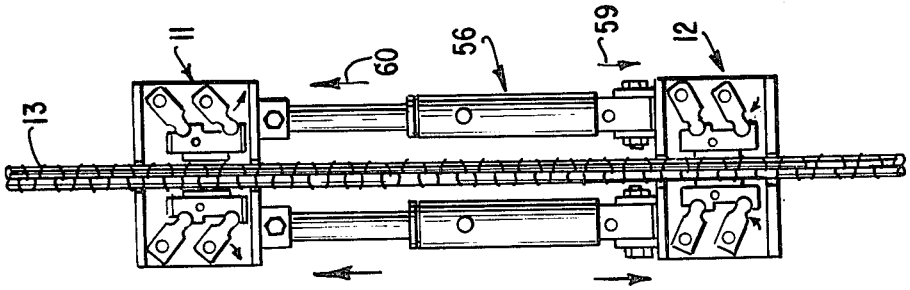
FIG. 10 is a schematic illustration of a second step in the lifting operation.
Figure 9:
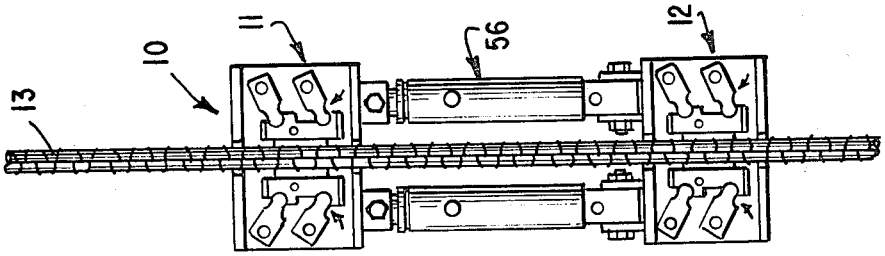
FIG. 9 is a schematic illustration of the arrangement of the gripping means and structural element in the position of FIG. 8.

Referring more specifically to FIGS. 9–12, jacking apparatus 10 is caused to lift the load by first raising the upper gripping device 11 while maintaining the lower gripping device 12 locked to the structural support member 13. As shown in FIG. 10, this is effected by an extension of the extensible means 56. Such extension applies a downward force 59 to the lower gripping device and an upward force 60 to the upper gripping device 11, as illustrated by the arrows in FIG. 10. Resultingly, a clockwise force is applied to the parallelogram linkage arrangement of the gripping jaws 21 and 22 and links 46, 47, 48 and 49 of the lower gripping device, so as to firmly retain the jaws 21 and 22 in interlocked association with the structural support member 13. On the other hand, the upward force to the upper gripping device 11 causes a counterclockwise force to be applied to the parallelogram linkage supporting the jaws 19 and 20, thereby permitting them to separate from their engagement with the structural support member 13 and permit upward movement of upper gripping device 11 so as to raise the load carried thereby.

Figure 11:
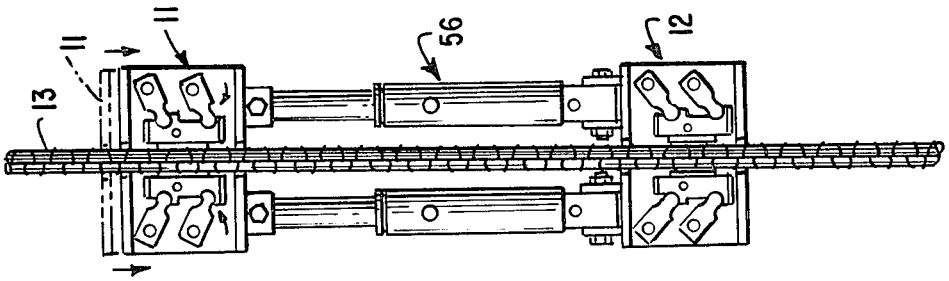
FIG. 11 is a schematic illustration of a third step in the lifting operation.

When the extensible means 56 reaches its limit of extension, as shown in FIG. 11, the top of upper gripping device 11 reaches the broken line disposition as a maximum upward displacement in that cycle of raising of the load. A small amount of downward movement, or retraction, of the extensible means 56 wherein the upper gripping device 11 moves from the broken line position to the full line position, releases the counterclockwise force acting on the parallelogram linkage and permits the springs 36 to urge the jaw guide plate 34 upwardly to the position of FIG. 8 wherein the guide pins 53 are urged inwardly to move the jaws 19 and 20 into mechanically interlocked association with the structural support member 13, as shown in FIG. 11. Any further downward force applied to the upper gripping device 11 by the load more firmly locks the gripping device in association with the structural support member 13 to assure a positive support of the load by the upper gripping device at this time.

Figure 12:
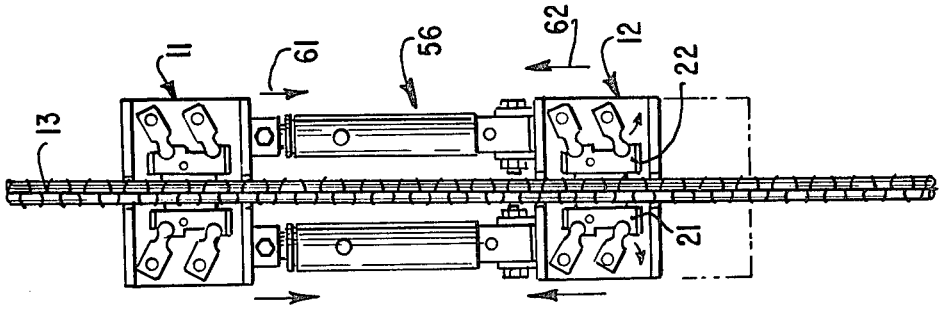
FIG. 12 is a schematic illustration of a fourth step in the lifting operation.

As the load is now carried fully by the upper gripping device, the lower gripping device 12 may be raised to complete the lifting step. This is effected simply by causing the extensible means 56 to retract from the position of FIG. 11 to the position of FIG. 12. As a result of such retraction, a downward force 61 is applied by the extensible means 56 to the upper gripping device 11 serving to further lock the upper gripping device to the structural support member. At the same time, an upward force 62 is exerted on the lower gripping device 12 thereby causing a counterclockwise urging of the parallelogram linkage thereof and corresponding movement of the jaws 21 and 22 away from structural support member 13 to permit raising of the lower gripping device 12 from the broken line disposition as shown in FIG. 12 to the full line disposition as shown therein. When the extensible means is fully retracted, the gripping devices 11 and 12 will be restored to the relative spaced disposition thereof, as in FIG. 9, so as to complete the lifting step. Further lifting steps may be sequentially effected by repeated extensions and retractions of the extensible means 56 to raise the load further on the structural support member as desired.

The forces discussed above are shown by the arrows identified by the different reference numerals applied thereto.

Figure 5:
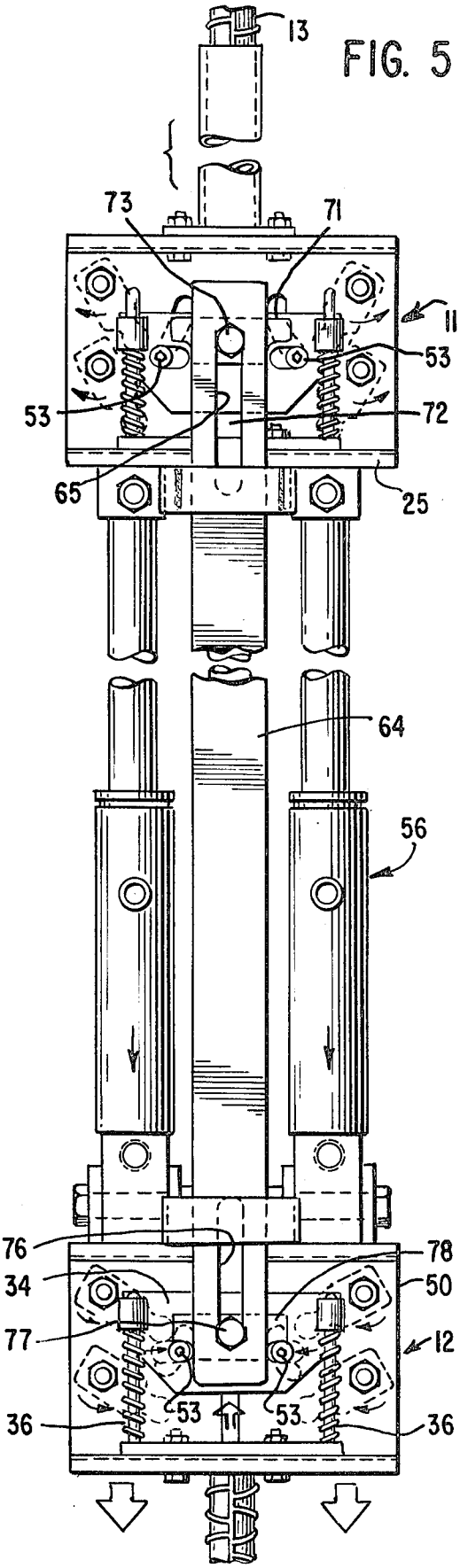
FIG. 5 is an elevation illustrating a second step in the downward movement of the apparatus.

Thus, it may be seen that the improved jacking apparatus 10 provides a simple automatic raising of the load on the structural support member as the result of successive extension and retraction operations of the extensible means 56 thereof. Apparatus 10 is further arranged to permit facilitated lowering thereof when desired by sequential retraction and extension operations. For this purpose, a lowering control generally designated 63 is provided, as shown in FIG. 1. As best seen in FIG. 7, the lower control includes an upper bar 64 having a vertical slot 65 adjacent its upper end and having its lower end 66 fixedly secured to top plate 24 of the lower gripping device 12 as by a welding bracket 67 secured to top plate 24 by suitable means, such as bolts 68. Bar 64 extends slidably upwardly through an upper bracket 69 secured to the lower plate 25 of upper gripping device 11, such as by bolts 70. A T-shaped jaw opening device 71 is guided for vertical movement on an upstanding slide post 72 carried on bottom plate 25 of the upper gripping device 11, as shown in FIG. 5. A stop pin 73 extends forwardly from the jaw opening device through slots 65 of the upper bar 64, as shown in FIGS. 5 and 7. As illustrated, stop pin 73 may comprise a bolt having its shank passed through slot 65.

As further shown in FIG. 7, a lower control bar 74 has its upper end 75 welded to a bracket 69 so as to be secured to the bottom plate 25 of upper gripping device 11. The lower end of lower control bar 74 is provided with a vertical slot 76. A stop pin 77 extends forwardly from a jaw opening device 78 similar to jaw opening device 71 and through slot 76, as illustrated in FIGS. 6 and 7. The T-shaped jaw opening device 78 is slidably carried on an upstanding slide pin 79 carried on the base 32 of slide device 31, as shown in FIGS. 6 and 7.

As further shown in FIG. 7, the lower end of lower bar 74 extends slidably through bracket 67.

The operation of jacking apparatus 10 in the lowering mode may be seen by sequential reference to FIGS. 4 and 6. Thus, as shown in FIG. 4, the upper gripping device 11 may be maintained in gripping engagement with the structural support member 13 with the jaw opening device 71 maintained effectively above the guide pin 53 and thereby permitting jaws 19 and 20 to remain in mechanically interlocked association with the structural support member. Extension of the extensible means 56 may now be effected to cause a lowering of the lower gripping device 12. As shown in FIG. 4, jaw opening device 78 extends between the guide pins 53 of the lower gripping device 12 so as to maintain the guide pins in their spaced-apart disposition maintaining the jaws 21 and 22 spaced from structural support member 13, such as illustrated in the lower portion of FIG. 2.

As a result of downward movement of the lower gripping device 12, stop pin 77 is carried downwardly therewith. However, during this initial movement, the jaw opening device maintains the jaws spaced apart as discussed above.

However, when the extensible means 56 reaches the limit of its downward movement, stop pin 77, as shown in FIG. 5, engages the lower end of slot 76 and resultingly, the jaw opening device 78 is urged upwardly from between the guide pins 53, permitting springs 36 to urge jaw guide plate 34 upwardly relative to carrier 51 and thereby cause inward movement of the jaw carriers and jaws 21 and 22 so as to effect mechanically interlocked engagement of jaws 21 and 22 with the structural support member.

As further shown in FIG. 5, when lower gripping device 11 reaches its lowermost position, upper control bar 64 has been moved downwardly as a result of its connection to top plate 24 of lower gripping device 12 so that slot 65 is correspondingly moved downwardly until the upper end of the slot is caused to engage the stop pin 73 on upper jaw opening device 71. This causes a downward and outward movement of the guide pins 53 resulting in a clockwise movement of the parallelogram linkage releasing the jaws 19 and 20 from their engagement with structural support member 13, and thereby releasing upper gripping device 11 from the structural support member.

Retraction of the extensible means 56 from the disposition of FIG. 5 to that of FIG. 6, now causes a downward movement of upper gripping device 11 from the broken line position shown in FIG. 6 to the full line position shown therein. At this time, the lower jaw opening device 78 is maintained above the guide pins 53 of lower gripping device 12 so as to permit maintained interlocked association of the lower gripping device with structural support member 13. However, the jaw opening device 71 of the uppper gripping device 11 is effectively maintained between the upper guide pins 53 to maintain jaws 19 and 20 spaced from structural support member 13 and permit free downward movement of upper gripping device 11 as a result of the retraction of the extensible means 56.

Such downward movement continues until upper gripping device 11 moves downwardly sufficiently so as to cause stop pin 73 thereon to abut the lower end of slot 65 and thereby urge the jaw opening device 71 from between the guide pins 53, permitting jaws 19 and 20 to be returned to the gripping engagement with support member 13 shown in FIG. 2. At the same time, the downward movement of upper gripping device 11 lowers the lower control bar 74 so as to bring the upper end of slot 76 thereof into abutment with stop pin 77 of lower gripping device 12 and thereby return the jaw opening device 78 to between guide pins 53 of lower gripping device 12, as shown in FIGS. 6 and 7, so as to ready the jacking apparatus for a subsequent step of lowering of the lower gripping device 12.

The above discussed sequence of lowering operations may be repeated as desired so as to effect a downward stepping movement of the jacking apparatus.

Thus, jacking apparatus 10 is further arranged to permit facilitated downward movement of the structure when desired. During the use of jacking apparatus in the raising mode, stop pins 73 and 77 may be removed so as to permit operation of the apparatus specifically in the manner as discussed above relative to the raising steps. Upon installation of the stop pins 73 and 77, sequential extension and retraction of the extensible means 56 effects the desired downward movement of the apparatus as discussed above.

As will be obvious to those skilled in the art, a plurality of such jacking apparatuses may be utilized in supporting a large structure, such as a building floor slab. The raising and lowering operations may be conducted suitably to effect the desired overall operation.

In the illustrated embodiment, the structural support member 13 may be defined by a reinforcing rod having suitable circumferential ribs defining the shoulder portions 18. As will be further obvious to those skilled in the art, the load may be lifted from the upper end of the structural support member or raised from the lower end thereof, as desired. As will be further obvious to those skilled in the art, the extensible means 56 may comprise any suitable extensible means including pneumatic means as well as the disclosed hydraulic piston and cylinder means.

The foregoing disclosure of specific embodiments is illustrative of the broad inventive concepts comprehended by the invention.

I claim:

1. In an apparatus for selectively moving a load, said apparatus being arranged for use with an elongated structural element having a plurality of longitudinally spaced substantially similar projecting shoulder portions, said apparatus having gripping means comprising:

wall means defining a portion of the gripping means engageable with said structural element and having a grooved surface configuration complementary to said shoulder portions of the structural element;

means for mounting said wall means adjacent said structural element including a parallelogram linkage carrying said wall means for causing the wall means to be maintained parallel to the longitudinal extent of the elongated structural element in engaging said element; and means for resiliently urging the wall means into engagement with said element to have mechanically interlocked engagement selectively with successive ones of said shoulder portions as said apparatus is caused to be aligned successively with said successive ones of the shoulder portions, said resilient urging means permitting said surface configuration of the wall means to adjustably seat on said shoulder portions for subsequent transfer of force from the load for firmly locking the gripping means to the element to support the load.

2. The load moving apparatus of claim 1 wherein said structural element comprises a cylindrical rod and said shoulder portions comprise semiannular projections on said structural element and said wall means surface configuration defines semiannular recesses complementary to said structural element projections.

3. In an apparatus for selectively moving a load, said apparatus being arranged for use with an elongated structural element having a plurality of longitudinally spaced substantially similar projecting shoulder portions, said apparatus having gripping means comprising:

wall means defining a portion of the gripping means engageable with said structural element and having a grooved surface configuration complementary to said shoulder portions of the structural element; and resilient means arranged to urge the wall means into accurate mechanically interlocked association with at least one of said structural element shoulder portions as an incident of relative logitudinal movement between said elongated structural element and said gripping means.

4. The load moving apparatus of claim 3 wherein said shoulder portions are spaced longitudinally of the structural element substantially uniformly a preselected distance apart.

5. The load moving apparatus of claim 3 wherein said shoulder portions are spaced apart approximately 2" longitudinally of the structural element.

6. The load moving apparatus of claim 3 wherein each said wall means surface configuration is arranged to engage concurrently a plurality of said structural element shoulder portions.

7. In an apparatus for selectively moving a load and arranged for use with an elongated structural element, said apparatus having gripping means releasably engaging the structural element for effecting the movement of the load, the improvement comprising means for mounting said gripping means adjacent said structural element including a parallelogram linkage causing the gripping means to be maintained parallel to the longitudinal extent of the elongated structural element in engaging said element, a fixed cam, and a cam follower movable with said gripping means for guiding the movement of the gripping means toward and from said structural element.

8. The load moving apparatus of claim 7 wherein said mounting means further includes means for biasing said linkage to urge said gripping means toward engagement with said structural element.

9. The load moving apparatus of claim 7 wherein said structural element is provided with a plurality of longitudinally spaced, substantially similar shoulder portions and said gripping means defines a surface configuration complementary to said shoulder portions of the structural element to have mechanically interlocked engagement selectively with successive ones of said shoulder portions as said apparatus is caused to be aligned successively with said successive ones of the shoulder portions.

10. In an apparatus for selectively raising and lowering a load and including an upper gripping means resiliently biased into gripping engagement with a vertical load supporting elongated structural element having a plurality of accurately uniformly vertically spaced shoulders, and a lower gripping means resiliently biased into gripping engagement with said structural element, means for controlling operation of the gripping means to effect an alternately descending series of engagements of said upper and lower gripping means with said structural element comprising:

extensible means for moving said gripping means selectively toward and from each other a distance accurately equal to a multiple of the spacing between said shoulders;

means on said gripping means defining a plurality of shoulders complementary to said structural element shoulders and correspondingly vertically spaced to be generally aligned with said structural element shoulders as an incident of the gripping means being resiliently biased into engagement with said structural element;

first control means carried by said upper gripping means for causing said lower gripping means to be released from said structural element as an incident of the upper gripping means being moved downwardly to a preselected minimum spacing of the upper gripping means above the lower gripping means with the lower gripping means engaged with said structural element; and second control means carried by said lower gripping means for causing said upper gripping means to be released from said structural element as an incident of the lower gripping means being moved downwardly to a preselected maximum spacing of the lower gripping means below the upper gripping the lower gripping means below the upper gripping means with the upper gripping means engaged with said structural element, each of said gripping means comprising a support, gripping elements movably carried on the support, and biasing means for biasing the gripping elements into engagement with the structural element, each said biasing means including a connector, spring means carried by the support and biasing the connector, and means responsive to movement of the connector relative to the support for moving the gripping elements, each said control means comprising a control member extending from the gripping means carrying the same to adjacent the connector of the other gripping means, and means defining a lost motion connector between said control member and adjacent connector.

11. The load raising and lowering apparatus of claim 10, wherein said extensible means comprises fluid-operated piston means.

12. In an apparatus for selectively raising and lowering a load and including an upper gripping means biased into gripping engagement with a vertical load supporting elongated structural element, and a lower gripping means biased into gripping engagement with said structural element, means for controlling operation of the gripping means to effect an alternately descending series of engagements of said upper and lower gripping means with said structural element comprising:

extensible means for moving said gripping means selectively toward and from each other;

first control means carried by said upper gripping means for causing said lower gripping means to be released from said structural element as an incident of the upper gripping means being moved downwardly to a preselected minimum spacing of the upper gripping means above the lower gripping means with the lower gripping means engaged with said structural element; and second control means carried by said lower gripping means for causing said upper gripping means to be released from said structural element as an incident of the lower gripping means being moved downwardly to a preselected maximum spacing of downwardly to a preselected minimum spacing of the upper gripping means above the lower gripping means with the lower gripping means engaged with said structural element; and second control means carried by said lower gripping means for causing said upper gripping means to be released from said structural element as an incident of the lower gripping means being moved downwardly to a preselected maximum spacing of the lower gripping means below the upper gripping means with the upper gripping means engaged with said structural element, each of said gripping means comprising a support, gripping elements pivotally carried on the support, and biasing means for biasing the gripping elements into engagement with the structural element, each said biasing means including a connector, spring means carried by the support and biasing the connector, and means responsive to movement of the connector relative to the support for pivoting the gripping elements, each said control means comprising a control member extending from the gripping means carrying the same to adjacent the connector of the other gripping means, and means defining a lost motion connector between said control member and adjacent connector.

13. In an apparatus for selectively raising and lowering a load and including an upper gripping means biased into gripping engagement with a vertical load supporting elongated structural element, and a lower gripping means biased into gripping engagement with said structural element, means for controlling operation of the gripping means to effect an alternately descending series of engagements of said upper and lower gripping means with said structural element comprising:

extensible means for moving said gripping means selectively toward and from each other;

first control means carried by said upper gripping means for causing said lower gripping means to be released from said structural element as an incident of the upper gripping means being moved means with the upper gripping means engaged with said structural element, said gripping means shoulders being firmly locked to said structural element shoulders as an incident of the gripping means gripping the structural element in supporting the load.

14. In an apparatus for selectively raising and lowering a load and including an upper gripping means biased into gripping engagement with a vertical load supporting elongated structural element, and a lower gripping means biased into gripping engagement with said structural element, means for controlling operation of the gripping means to effect an alternately descending series of engagements of said upper and lower gripping means with said structural element comprising:

extensible means for moving said gripping means selectively toward and from each other;

first control means carried by said upper gripping means for causing said lower gripping means to be released from said structural element as an incident of the upper gripping means being moved downwardly to a preselected minimum spacing of the upper gripping means above the lower gripping means with the lower gripping means engaged with said structural element; and second control means carried by said lower gripping means for causing said upper gripping means to be released from said structural element as an incident of the lower gripping means being moved downwardly to a preselected maximum spacing of the lower gripping means below the upper gripping means with the upper gripping means engaged with said structural element, each of said gripping means comprising a support, gripping elements movably carried on the support, and biasing means for biasing the gripping elements into engagement with the structural element, each said biasing means including a connector, spring means carried by the support and biasing the connector, and means responsive to movement of the connector relative to the support for moving the gripping elements, each said control means comprising a control member extended from the gripping means carrying the same to adjacent the connector of the other gripping means, and means defining a lost motion connector between said control member and adjacent connector including a portion of the control member defining a vertically elongated slot and a follower carried by the connector and movably received in said slot.

15. In an apparatus for selectively raising and lowering a load and including an upper gripping means biased into gripping engagement with a vertical load supporting elongated structural element, and a lower gripping means biased into gripping engagement with said structural element, means for controlling operation of the gripping means to effect an alternately descending series of engagements of said upper and lower gripping means with said structural element comprising:

extensible means for moving said gripping means selectively toward and from each other;

first control means carried by said upper gripping means released from said structural element as an incident of the upper gripping means being moved downwardly to a preselected minimum spacing of the upper gripping means above the lower gripping means with the lower gripping means engaged with said structural element; and second control means carried by said lower gripping means for causing said upper gripping means to be released from said structural element as an incident of the lower gripping means being moved downwardly to a preselected maximum spacing of the lower gripping means below the upper gripping means with the upper gripping means engaged with said structural element, each of said gripping means comprising a support, gripping elements movably carried on the support, and biasing means for biasing the gripping elements into engagement with the structural element, each said biasing means including a connector, spring means carried by the support and biasing the connector, and means responsive to movement of the connector relative to the support for moving the gripping elements including a portion of the connector defining a slot and a follower carried by a gripping element and movably received in said slot, each said control means comprising a control member extended from the gripping means carrying the same to adjacent the connector of the other gripping means, and means defining a lost motion connector between said control member and adjacent connector.

16. In an apparatus for selectively raising and lowering a load and including an upper gripping means biased into gripping engagement with a vertical load supporting elongated structural element, and a lower gripping means biased into gripping engagement with said structural element, means for controlling operation of the gripping means to effect an alternately descending series of engagements of said upper and lower gripping means with said structural element comprising:

extensible means for moving said gripping means selectively toward and from each other;

first control means carried by said upper gripping means released from said structural element as an incident of the upper gripping means being moved downwardly to a preselected minimum spacing of the upper gripping means above the lower gripping means with the lower gripping means engaged with said structural element; and second control means carried by said lower gripping means for causing said upper gripping means to be released from said structural element as an incident of the lower gripping means being moved downwardly to a preselected maximum spacing of the lower gripping means below the upper gripping means with the upper gripping means engaged with said structural element, each of said gripping means comprising an arcuate support, gripping elements pivotally carried on the support, and biasing means for biasing the gripping elements into engagement with the structural element, each said biasing means including a connector, spring means carried by the support and biasing the connector, and means responsive to movement of the connector relative to the support for pivoting the gripping elements, each said control means comprising a control member extending from the gripping means carrying the same to adjacent the connector of the other gripping means, and means defining a lost motion connector between said control member and adjacent connector.

17. In an apparatus for selectively raising and lowering a load and including an upper gripping means biased into gripping engagement with a vertical load supporting elongated structural element, and a lower gripping means biased into gripping engagement with said structural element, means for controlling operation of the gripping means to effect an alternately descending series of engagements of said upper and lower gripping means with said structural element comprising:

extensible means for moving said gripping means selectively toward and from each other;

first control means carried by said upper gripping means released from said structural element as an incident of the upper gripping means being moved downwardly to a preselected minimum spacing of the upper gripping means above the lower gripping means with the lower gripping means engaged with said structural element; and second control means carried by said lower gripping means for causing said upper gripping means to be released from said structural element as an incident of the lower gripping means being moved downwardly to a preselected maximum spacing of the lower gripping means below the upper gripping means with the upper gripping means engaged with said structural element, each of said gripping means comprising a support, gripping elements, linkage means pivotally carried on the support and swingably carrying said gripping elements for movement toward and from the structural element, and biasing means for biasing the gripping elements into engagement with the structural element, each said biasing means including a connector, and means responsive to movement of the connector relative to the support for moving the gripping elements, each said control means comprising a control member extending from the gripping means carrying the same to adjacent the connector of the other gripping means, and means defining a lost motion connector between said control member and adjacent connector.

18. In an apparatus for selectively raising and lowering a load and including an upper gripping means biased into gripping engagement with a vertical load supporting elongated structural element, and a lower gripping means biased into gripping engagement with said structural element, means for controlling operation of the gripping means to effect an alternately descending series of engagements of said upper and lower gripping means with said structural element comprising:

extensible means for moving said gripping means selectively toward and from each other;

first control means carried by said upper gripping means released from said structural element as an incident of the upper gripping means being moved downwardly to a preselected minimum spacing of the upper gripping means above the lower gripping means with the lower gripping means engaged with said structural element; and second control means carried by said lower gripping means for causing said upper gripping means to be released from said structural element as an incident of the lower gripping means being moved downwardly to a preselected maximum spacing of the lower gripping means below the upper gripping means with the upper gripping means engaged with said structural element, each of said gripping means comprising a support, gripping elements parallelogram linkage means pivotally carried on the support and swingably carrying said gripping elements for movement toward and from the structural element with said gripping elements maintained extending accurately parallel to the longitudinal extent of said structural element, each said biasing means including a connector spring means carried by the support and biasing the connector, and means responsive to movement of the connector relative to the support for moving the gripping elements, each said control means comprising a control member extending from the gripping means carrying the same to adjacent the connector of the other gripping means, and means defining a lost motion connector between said control member and adjacent connector.

* * * * *